US011472648B2

(12) United States Patent
Morohashi et al.

(10) Patent No.: US 11,472,648 B2
(45) Date of Patent: Oct. 18, 2022

(54) SHEET SUPPORTING APPARATUS AND IMAGE FORMING APPARATUS

(71) Applicant: CANON KABUSHIKI KAISHA, Tokyo (JP)

(72) Inventors: Kazuya Morohashi, Suntou-gun (JP); Akira Matsushima, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 426 days.

(21) Appl. No.: 16/676,989

(22) Filed: Nov. 7, 2019

(65) Prior Publication Data

US 2020/0172354 A1 Jun. 4, 2020

(30) Foreign Application Priority Data

Nov. 30, 2018 (JP) ..... JP2018-225288

(51) Int. Cl.
*B65H 1/26* (2006.01)
*G03G 15/00* (2006.01)
*A47B 88/467* (2017.01)

(52) U.S. Cl.
CPC ..... *B65H 1/266* (2013.01); *A47B 88/467* (2017.01); *G03G 15/6529* (2013.01)

(58) Field of Classification Search
CPC ..... B65H 1/266; B65H 2402/64; B65H 2405/31; B65H 2405/121; G03G 15/6502; G03G 15/6529; A47B 88/467
See application file for complete search history.

(56) References Cited

U.S. PATENT DOCUMENTS

| | | | | |
|---|---|---|---|---|
| 7,469,892 | B2 | 12/2008 | Iwase et al. | |
| 9,637,331 | B2 | 5/2017 | Iwama | |
| 9,840,382 | B2 | 12/2017 | Okazaki et al. | |
| 10,233,041 | B2 | 3/2019 | Okazaki et al. | |
| 2004/0237252 | A1* | 12/2004 | Hoshide | A47B 88/467 16/72 |

(Continued)

FOREIGN PATENT DOCUMENTS

| | | | |
|---|---|---|---|
| JP | 2006-151687 | A | 6/2006 |
| JP | 2008-254841 | A | 10/2008 |
| JP | 2016-193769 | A | 11/2016 |

OTHER PUBLICATIONS

Masato Suzuki, U.S. Appl. No. 16/703,967, filed Dec. 5, 2019.

*Primary Examiner* — Luis A Gonzalez
(74) *Attorney, Agent, or Firm* — Venable LLP

(57) ABSTRACT

A sheet supporting apparatus includes a sheet supporting unit having a sheet supporting portion including a supporting surface on which a sheet is supported, and a first engagement unit attached to the sheet supporting portion, and a second engagement unit to draw in the sheet supporting unit toward an attaching position where the sheet supporting unit is attached to an apparatus body. The first engagement unit includes a first engagement portion, a base portion supported by the sheet supporting portion, and a holder that is supported movably in a perpendicular direction perpendicular to the supporting surface by the base portion and configured to hold the first engagement portion. The base portion supports the holder swingably around a swing shaft that extends in a direction orthogonal to both the perpendicular direction and an inserting direction in which the sheet supporting unit is inserted.

17 Claims, 9 Drawing Sheets

(56) References Cited

U.S. PATENT DOCUMENTS

| | | | | |
|---|---|---|---|---|
| 2008/0180764 | A1* | 7/2008 | Wakiyama | G03G 21/1695 358/498 |
| 2013/0032996 | A1* | 2/2013 | Kubota | B65H 1/266 271/145 |
| 2013/0285317 | A1* | 10/2013 | Ishikura | B65H 1/00 271/241 |
| 2016/0334745 | A1* | 11/2016 | Kwon | G03G 15/6502 |
| 2019/0077621 | A1 | 3/2019 | Kato et al. | |

* cited by examiner

SHEET SUPPORTING APPARATUS AND IMAGE FORMING APPARATUS

BACKGROUND OF THE INVENTION

Field of the Invention

The present invention relates to a sheet supporting apparatus for supporting sheets, and an image forming apparatus equipped with the same.

Description of the Related Art

Heretofore, a printer including a printer body, a sheet feed cassette capable of being attached detachably to the printer body, and a drawing apparatus for drawing and attaching the sheet feed cassette into the printer body is proposed (refer to Japanese Patent Application Laid-Open Publication No. 2006-151687). The drawing apparatus draws in a locking pin provided on the sheet feed cassette by urging force of a toggle spring, by which the sheet feed cassette is attached to the printer body. The locking pin is supported pivotably in right and left directions by a pin retaining arm provided on the sheet feed cassette.

However, the locking pin disclosed in Japanese Patent Application Laid-Open Publication No. 2006-151687 is arranged to protrude from a rear side of the sheet feed cassette, and it is not arranged movably in a vertical direction with respect to the sheet feed cassette. Therefore, if the whole body of the sheet feed cassette is drawn out of the printer body and the sheet feed cassette is placed on a worktable, for example, the locking pin may collide against the worktable or an object placed on the worktable. In this state, if load in the vertical direction is applied on the locking pin, the locking pin may be damaged.

SUMMARY OF THE INVENTION

According to one aspect of the present invention, a sheet supporting apparatus includes an apparatus body, a sheet supporting unit comprising a sheet supporting portion including a supporting surface on which a sheet is supported, and a first engagement unit attached to the sheet supporting portion, the sheet supporting unit being configured to be attached to and drawn out of the apparatus body, and a second engagement unit provided on the apparatus body and configured to draw in the sheet supporting unit toward an attaching position where the sheet supporting unit is attached to the apparatus body, wherein the first engagement unit comprises a first engagement portion, and a holder that is supported movably in a perpendicular direction perpendicular to the supporting surface and configured to hold the first engagement portion, and the second engagement unit comprises a second engagement portion configured to engage with the first engagement portion, and a drawing-urging portion configured to urge the second engagement portion so that the sheet supporting unit is drawn toward the attaching position in a state where the second engagement portion is engaged with the first engagement portion.

Further features of the present invention will become apparent from the following description of exemplary embodiments with reference to the attached drawings.

DESCRIPTION OF THE EMBODIMENTS

First Embodiment

Figure 1:
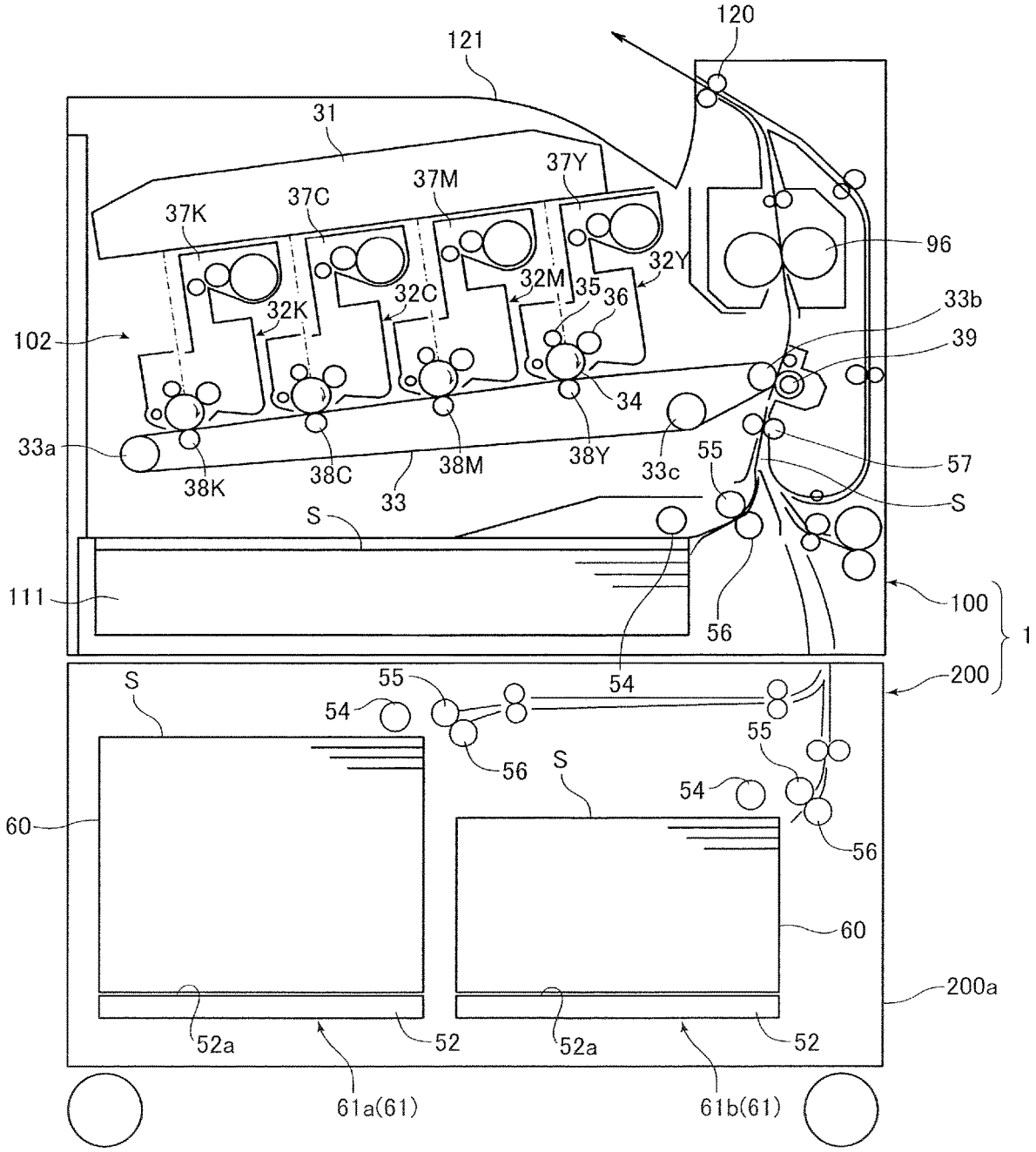
FIG. 1 is a general schematic diagram illustrating a printer according to a first embodiment.

Now, a first embodiment will be described with reference to the drawings. In the following description, a state in which the image forming apparatus is viewed from a front side, that is, viewpoint of FIG. 1, is referred to as reference to describe positional relationships including up, down, right, left, front and rear sides.

General Configuration

At first, the first embodiment will be described. A printer 1 serving as an image forming apparatus is a laser beam printer adopting an electrophotographic system. The printer 1 includes, as illustrated in FIG. 1, a printer body 100, and a sheet feeding apparatus 200 that is connected to a lower portion of the printer body 100 and in which sheets are stacked.

The printer body 100 includes a main cassette 111 that supports stacked sheets S, an image forming unit 102 that forms an image on a sheet S, a fixing unit 96 that fixes an image on a sheet S, and a sheet discharge roller pair 120. A sheet discharge tray 121 on which the sheet S discharged by the sheet discharge roller pair 120 is placed is provided on an upper portion of the printer body 100.

The image forming unit 102 is an image forming unit adopting a so-called four-drum full color system equipped with a laser scanner 31, four process cartridges 32Y, 32M, 32C and 32K, and an intermediate transfer belt 33. The process cartridges 32Y, 32M, 32C and 32K form toner images of respective colors of yellow (Y), magenta (M), cyan (C) and black (K), and the configurations other than the toner color are the same. Therefore, only the configuration of the process cartridge 32Y will be described, and the description of the other process cartridges 32M, 32C and 32K will be omitted. The process cartridge 32Y includes a photosensitive drum 34, a charge roller 35, and a developing roller 36. Toner cartridges 37Y, 37M, 37C and 37K that store toners of respective colors are attached detachably to the printer body 100 at an upper portion of the image forming unit 102.

An intermediate transfer belt 33 is wound around a drive roller 33*a*, a secondary transfer counter roller 33*b* and a tension roller 33*c*, and it is arranged below the four process cartridges 32Y, 32M, 32C and 32K. The intermediate transfer belt 33 is arranged to be in contact with the photosensitive drums of the respective process cartridges 32Y, 32M, 32C and 32K, and driven to rotate in a counterclockwise direction by the drive roller 33*a*. Further, four primary transfer rollers 38Y, 38M, 38C and 38K that abut against an inner circumferential surface of the intermediate transfer belt 33 at positions opposed to the respective photosensitive drums are provided on an inner side of the intermediate transfer belt 33. Further, the image forming unit 102 includes a secondary transfer roller 39 that abuts against an outer circumferential surface of the intermediate transfer belt 33 at a position opposed to the secondary transfer counter roller 33*b*.

Figure 2:
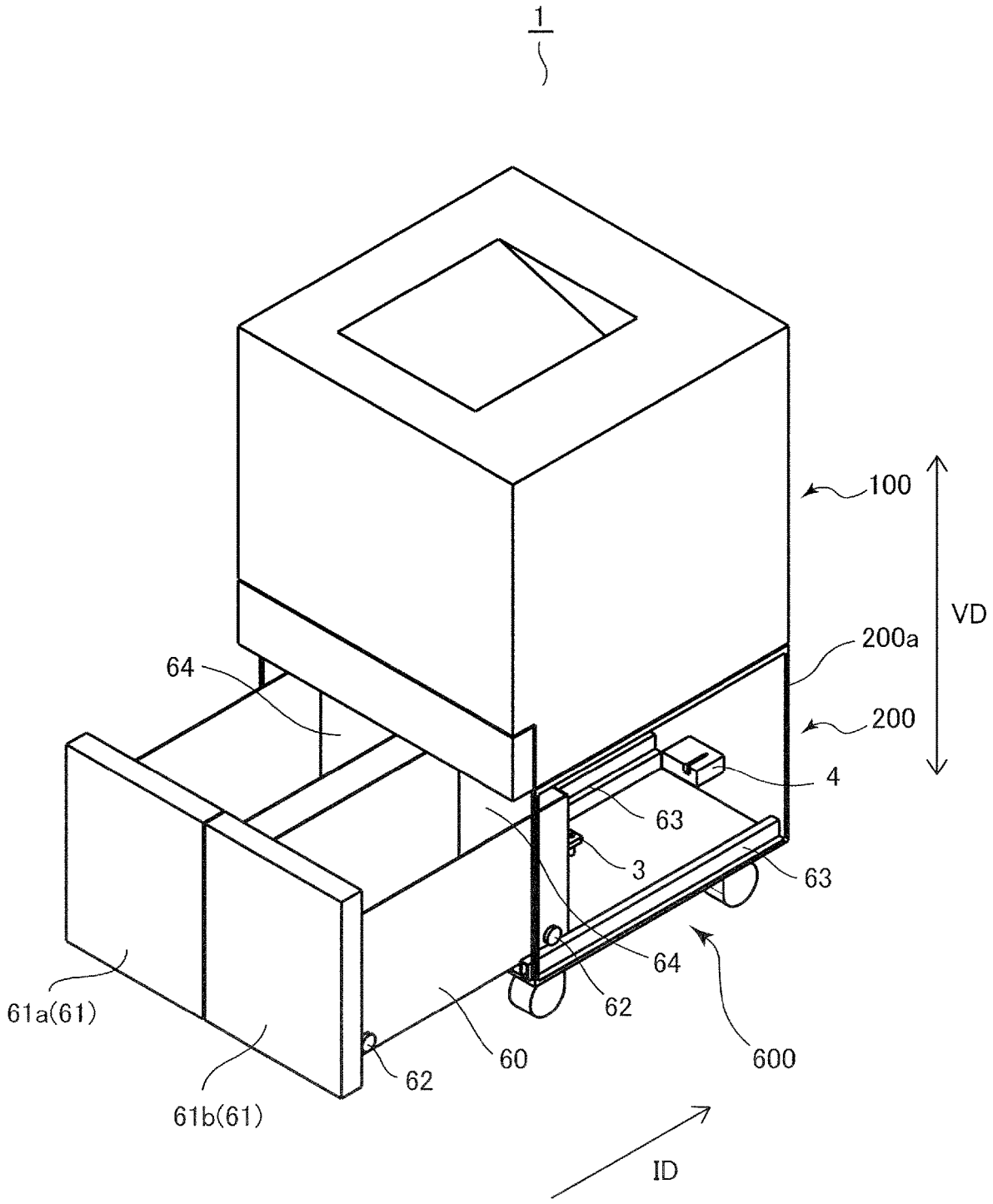
FIG. 2 is a perspective view illustrating a printer in a state where a storage portion is drawn out.

The sheet feeding apparatus 200 includes two deck-type storage portions 61*a* and 61*b* which are arranged on right and left sides. The configurations of the storage portions 61*a* and 61*b* and the circumference configurations thereof are approximately the same, so in the following description, an arbitrary one of the two storage portions 61*a* and 61*b* on left and right sides is described as a storage portion 61. As illustrated in FIGS. 1 and 2, the storage portion 61 serving as a sheet supporting unit is attached to and drawn out of a casing 200*a* of the sheet feeding apparatus 200. The casing 200*a* serving as an apparatus body includes a pair of guide rails 63 that extend in parallel with an inserting direction ID of the storage portion 61, and a plurality of support rollers 62 are supported rotatably on a side of the storage body 60. The storage portion 61 is inserted to and drawn out of the casing 200*a* by the support rollers 62 moving in rotating motion along the guide rails 63.

The storage portion 61 includes a storage body 60 that serves as a sheet supporting portion that supports sheets S, and a drawing arm unit 3 that serves as a first engagement unit that is attached to a rear wall 64 of the storage body 60. A drawing mechanism 4 for drawing the storage portion 61 toward the attaching position is attached to the casing 200*a* in a state engaged with the drawing arm unit 3. The casing 200*a*, the storage portion 61, the drawing arm unit 3 and the drawing mechanism 4 constitute a sheet supporting apparatus 600. The drawing arm unit 3 and the drawing mechanism 4 will be described in detail later. A lift plate 52 on which the sheets S are placed on a supporting surface 52*a* thereof and capable of being lifted and lowered by a wire is provided on the storage body 60.

Next, an image forming process of the printer body 100 configured as above will be described. In a state where image data transmitted from a personal computer and the like not shown is entered to the laser scanner 31, laser beam corresponding to the image data is irradiated from the laser scanner 31 on the photosensitive drum 34 of the process cartridge 32Y.

In this state, the surface of the photosensitive drum 34 is charged uniformly to a predetermined polarity and potential in advance by the charge roller 35, and electrostatic latent image is formed on the surface by the laser beam irradiated from the laser scanner 31. The electrostatic latent image formed on the photosensitive drum 34 is developed by the developing roller 36, and a yellow (Y) toner image is formed on the photosensitive drum 34.

Similarly, laser beams are irradiated from the laser scanner 31 to respective photosensitive drums of the process cartridges 32M, 32C and 32K, and toner images of magenta (M), cyan (C) and black (K) are formed on the respective photosensitive drums. The toner images of respective colors formed on the respective photosensitive drums are transferred to the intermediate transfer belt 33 by the primary transfer roller 38Y, 38M, 38C and 38K, and conveyed to the secondary transfer roller 39 by the intermediate transfer belt 33 rotated by the drive roller 33*a*. The image forming processes of respective colors are performed at such a timing that the images are superposed on a primary transfer toner image formed upstream on the intermediate transfer belt 33.

In parallel with the image forming process, the sheet S stacked and supported on the main cassette 111 of the printer body 100 or the storage portion 61 of the sheet feeding apparatus 200 is fed in a sheet feeding direction by a pickup roller 54. Then, the sheet S fed by the pickup roller 54 is separated one by one by a feed roller 55 and a separation roller 56, and the sheet is conveyed toward a registration roller pair 57. A loop is formed on the sheet S being abutted against the registration roller pair 57 in a rotation stopped state, and skewing of the sheet is corrected.

The registration roller pair 57 is driven in synchronization with the image forming timing, and the sheet S is conveyed to the secondary transfer roller 39. A full-color toner image on the intermediate transfer belt 33 is transferred to the sheet S conveyed to the secondary transfer roller 39 by secondary transfer bias applied to the secondary transfer roller 39. Predetermined heat and pressure are applied by the fixing unit 96 to the sheet S to which the toner image is transferred, by which toner is melted to fix the toner image on the sheet. The sheet S having passed through the fixing unit 96 is discharged by the sheet discharge roller pair 120 to the sheet discharge tray 121.

Drawing Mechanism

Figure 3A:
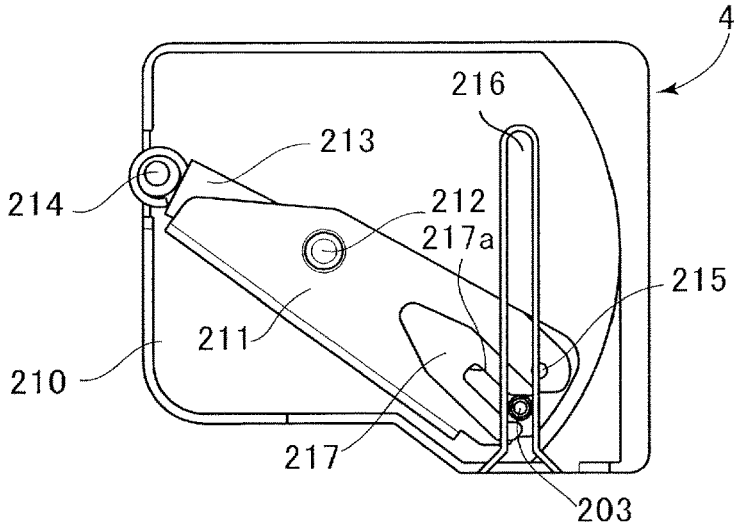
FIG. 3A is a schematic drawing illustrating a state where a locking pin is in contact with a concave portion of a gripping member.
Figure 3B:
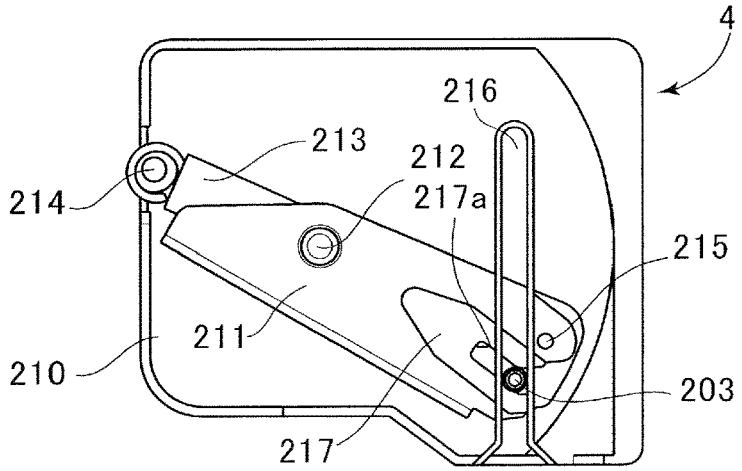
FIG. 3B is a schematic drawing illustrating a state where the locking pin is pressing the concave portion.
Figure 3C:
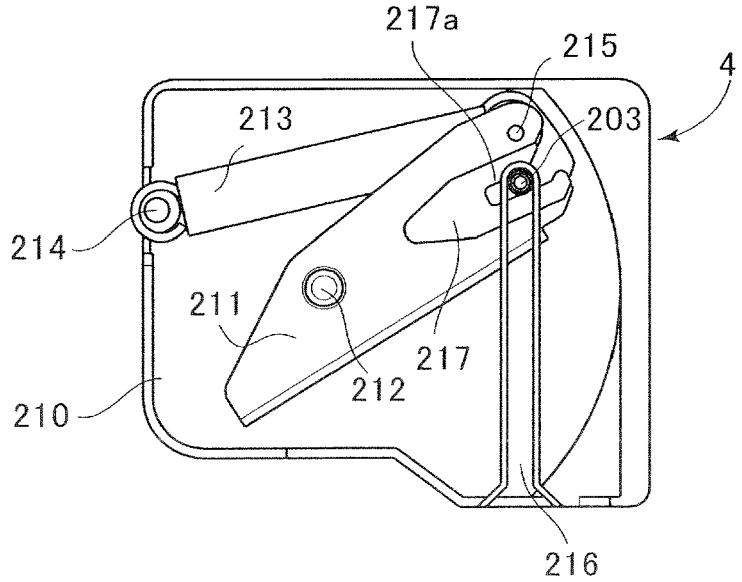
FIG. 3C is a schematic drawing illustrating a position of the locking pin in a state where the storage portion is positioned at an attaching position.

Next, a drawing mechanism 4 serving as a second engagement unit will be described in detail, with reference to FIGS. 3A to 3C. The drawing mechanism 4 includes, as illustrated in FIG. 3A, a frame body 210, a swing arm 211 supported pivotally around a pivot shaft 212 with respect to the frame body 210, and a gripping member 217 attached to a leading end portion of the swing arm 211. Further, the drawing mechanism 4 includes a toggle spring 213 having a first end connected to a shaft 214 provided on the frame body 210 and a second end connected to a shaft 215 provided on the swing arm 211. The toggle spring 213 serving as a drawing-urging portion pivots around the shaft 214 serving as fulcrum along with the swinging of the swing arm 211.

A guide groove 216 is formed on the frame body 210, and a locking pin 203 serving as a first engagement portion of the drawing arm unit 3 is guided along the guide groove 216.

The gripping member 217 serving as a second engagement portion includes a concave portion 217*a* capable of being engaged with the locking pin 203. In a state where the storage portion 61 is drawn out, the gripping member 217 is positioned at a receiving position by the operation of the toggle spring 213, as illustrated in FIG. 3A, and at this time, the concave portion 217*a* can receive the looking pin 203 guided by the guide groove 216.

In a state where the storage portion 61 in a state drawn out of the casing 200*a* (refer to FIG. 2) is pressed toward the attaching position, as illustrated in FIG. 3A, the locking pin 203 contacts the concave portion 217*a* of the gripping member 217. In a state where the storage portion 61 is further pushed in, the locking pin 203 presses the concave portion 217*a*, and the swing arm 211 pivots around the pivot shaft 212 against the urging force of the toggle spring 213. As illustrated in FIG. 3B, in a state where the shafts 214 and 215 and the pivot shaft 212 are aligned in a straight line, the toggle spring 213 will be at a neutral position where urging force is not applied on the swing arm 211.

If the storage portion 61 is further pushed in from this state, the toggle spring 213 urges the storage portion 61 to be drawn in toward the attaching position through the gripping member 217, the swing arm 211 and the locking pin 203. Then, as illustrated in FIG. 3C, even in a state where the storage portion 61 is positioned at the attaching position, the toggle spring 213 applies urging force to the storage portion 61. Thereby, the storage portion 61 can maintain the attaching position stably and feed the sheet S at an appropriate position.

Drawing Arm Unit

Next, the drawing arm unit 3 will be described in detail with reference to FIGS. 4A to 7B. The drawing arm unit 3 is attached to the rear wall 64 of the storage body 60. The drawing arm unit 3 includes a horizontal swing arm 201, a perpendicular swing arm 202, the locking pin 203, an urging spring 206, a perpendicular arm shaft 204, and a horizontal arm shaft 205.

The horizontal arm shaft 205 serving as a shaft extending in a vertical direction VD serving as a perpendicular direction is arranged at the rear wall 64, and it is inserted to a shaft hole 201*a* provided on the horizontal swing arm 201. The horizontal swing arm 201 serving as a base portion is supported swingably in the horizontal direction around the horizontal arm shaft 205. Thereby, the locking pin 203 described later is also swingable in the horizontal direction, and it plays a role in absorbing relative positional error between the locking pin 203 and the concave portion 217*a* of the gripping member 217.

A shaft hole 201*b* that extends in the horizontal direction is formed on the horizontal swing arm 201, and a shaft hole 202*a* is formed also on the perpendicular swing arm 202. The perpendicular arm shaft 204 is inserted to the shaft holes 201*b* and 202*a*, and the perpendicular swing arm 202 is swingable in the vertical direction around the perpendicular arm shaft 204 serving as the swing shaft. The perpendicular arm shaft 204 extends in a direction orthogonal to both of an inserting direction of the sheet and the vertical direction. A pin hole 202*b* is formed on the leading end portion of the perpendicular swing arm 202 serving as a holder, and the locking pin 203 is fixed to the pin hole 202*b*.

In the following description, a state in which the printer 1 is mounted on a horizontal supporting surface is referred to in describing the vertical direction and up-down direction, and the perpendicular direction perpendicular to the supporting surface 52*a* (refer to FIG. 1) of the lift plate 52 is referred to as the vertical direction and up-down direction. However, the present invention is not limited thereto, and for example, in a state where the storage portion 61 is drawn out of the casing 200*a*, the perpendicular swing arm 202 is swingable in a direction perpendicular to the supporting surface 52*a*. Further, the present invention is not limited to the lift plate 52 lifted and lowered by a wire, and the supporting surface of an intermediate plate that is lifted and lowered by a gear and the like can be set as reference.

Figure 4A:
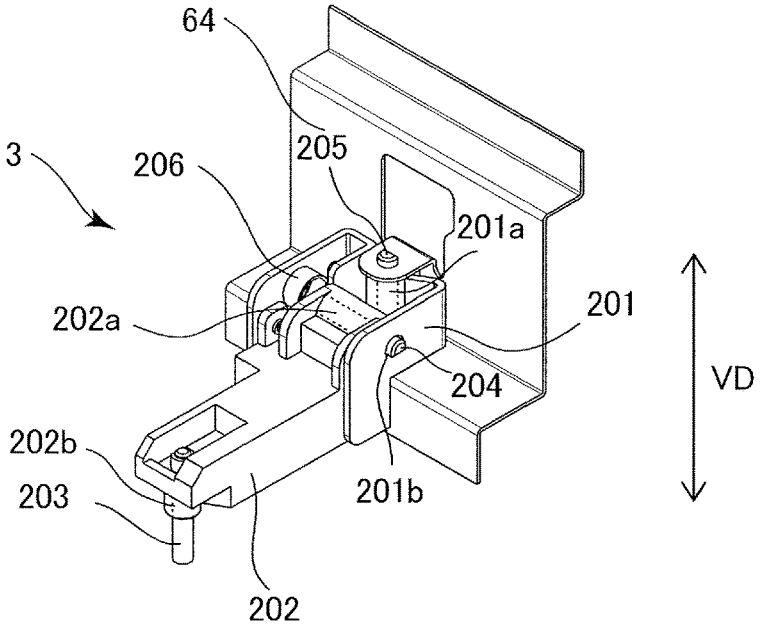
FIG. 4A is a perspective view illustrating a drawing arm unit.
Figure 4B:
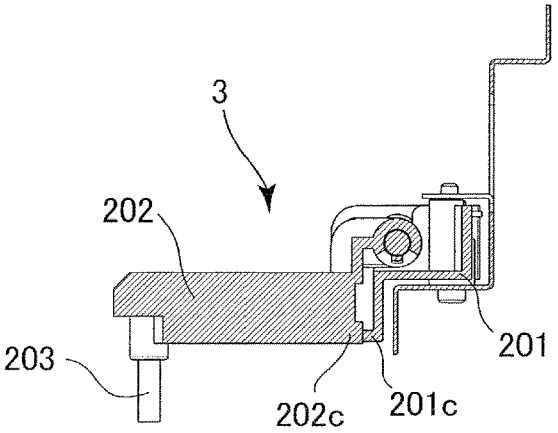
FIG. 4B is a cross-sectional view illustrating the drawing arm unit.

The urging spring 206 serving as an urging portion is a torsion coil spring arranged around the perpendicular arm shaft 204, and it urges the perpendicular swing arm 202 downward. The perpendicular swing arm 202 includes an abutment portion 202*c*, as illustrated in FIG. 4B, and in a state where the abutment portion 202*c* is abutted against a stopper portion 201*c* formed on the horizontal swing arm 201, swinging movement to a lower direction is limited. The perpendicular swing arm 202 is positioned so that its longitudinal direction corresponds to the horizontal direction by the urging force of the urging spring 206 and the contact between the abutment portion 202*c* and the stopper portion 201*c*.

Figure 4C:
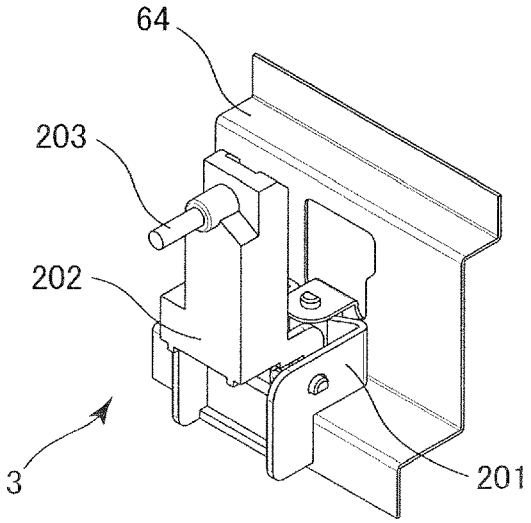
FIG. 4C is a perspective view illustrating a state where the drawing arm unit is pushed up.

That is, in a non-loaded state where external force is not applied, the locking pin 203 fixed to the perpendicular swing arm 202 is positioned at a standby position as illustrated in FIG. 4B by urging force of the urging spring 206. Meanwhile, in a state where external force acts upward from below, as illustrated in FIG. 4C, the locking pin 203 swings upward. In a state where external force to the locking pin 203 or the perpendicular swing arm 202 is released, the locking pin 203 returns to the standby position. In other words, the locking pin 203 is positioned at the standby position in a state where external force is not applied, and if external force containing a component in the vertical direction acts on the locking pin 203, the locking pin swings in the vertical direction around the perpendicular arm shaft 204 together with the perpendicular swing arm 202. In the present embodiment, swinging movement of the perpendicular swing arm 202 in the downward direction is regulated by the abutment portion 202*c* abutting against the stopper portion 201*c*, but a configuration can be adopted where the perpendicular swing arm 202 is movable in the downward direction from the standby position.

Figure 5A:
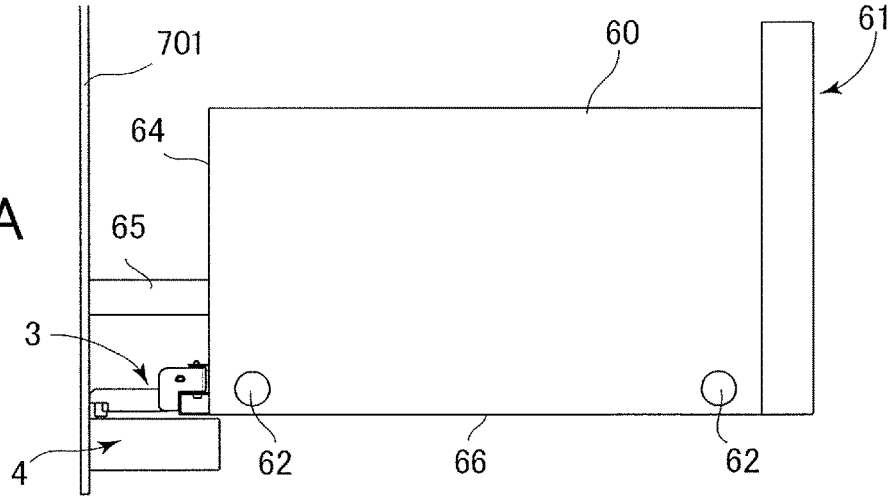
FIG. 5A is a side view illustrating a state where a storage portion is positioned at an attaching position.

In the present embodiment, as illustrated in FIG. 5A, the storage portion 61 is drawn in by the drawing mechanism 4, and in a state where the storage portion 61 is positioned at the attaching position, a contact portion 65 provided at a rear portion of the storage portion 61 contacts a side panel 701 of the casing 200*a* (refer to FIG. 2). Thereby, the storage portion 61 is positioned at the attaching position.

In this case, a draw-in force in which the drawing mechanism 4 draws in the storage portion 61 may cause elastic deformation of the rear wall 64 on which the drawing arm unit 3 is attached. If the rear wall 64 is elastically deformed, the position of the sheet S in the storage portion 61 may become unstable, and may affect the quality of the image. Therefore, it is preferable to attach the drawing arm unit 3 to a position of the storage portion 61 where stiffness is as high as possible, and in the box-shaped storage body 60 with an upper portion opened, it should be attached to a position closed to a bottom plate 66 of the storage body 60.

Figure 5B:
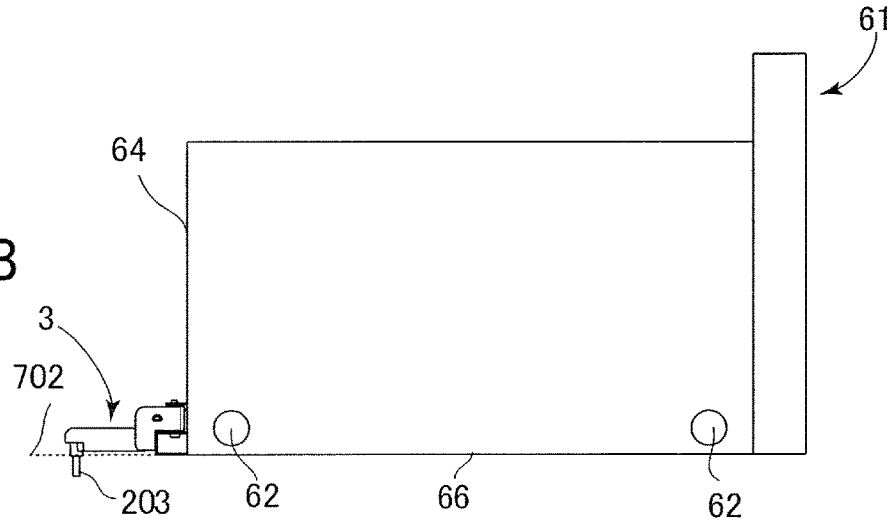
FIG. 5B is a side view illustrating an arrangement of the drawing arm unit.

Therefore, as illustrated in FIG. 5B, the drawing arm unit 3 according to the present embodiment is, as illustrated in FIG. 5B, arranged so as to overlap with an extension plane 702 that extends in the horizontal direction of the bottom plate 66 of the storage portion 61 in the non-loaded state. The locking pin 203 is protruded downward from the extension plane 702. That is, the locking pin 203 is protruded downward from the bottom plate 66.

Figure 6A:
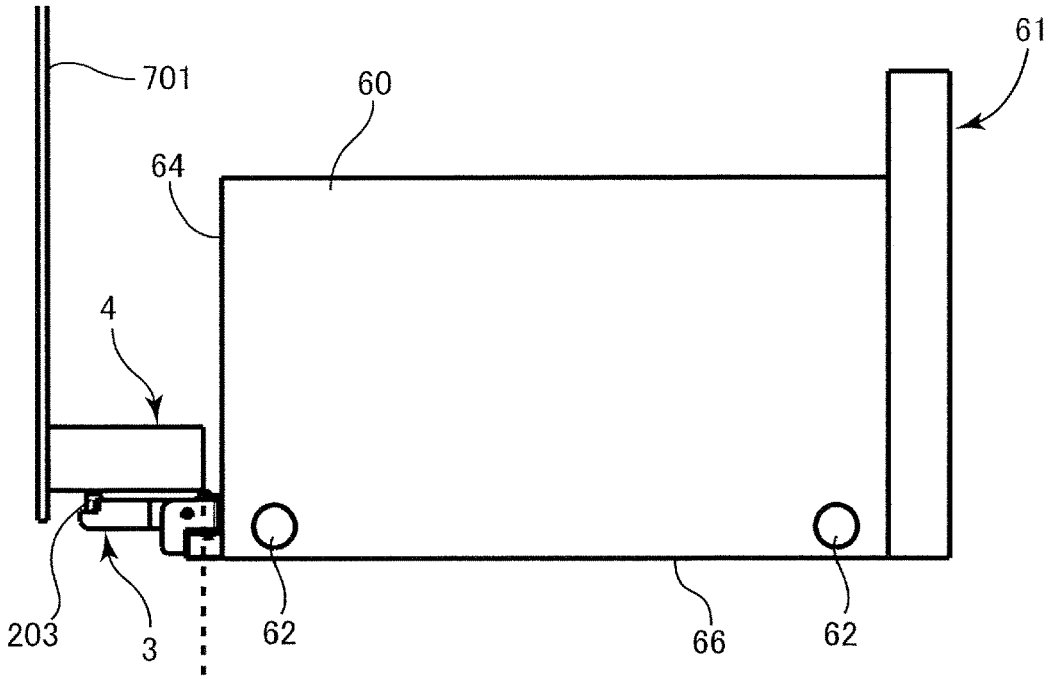
FIG. 6A is a side view illustrating an arrangement of a drawing mechanism according to a modification.
Figure 6B:
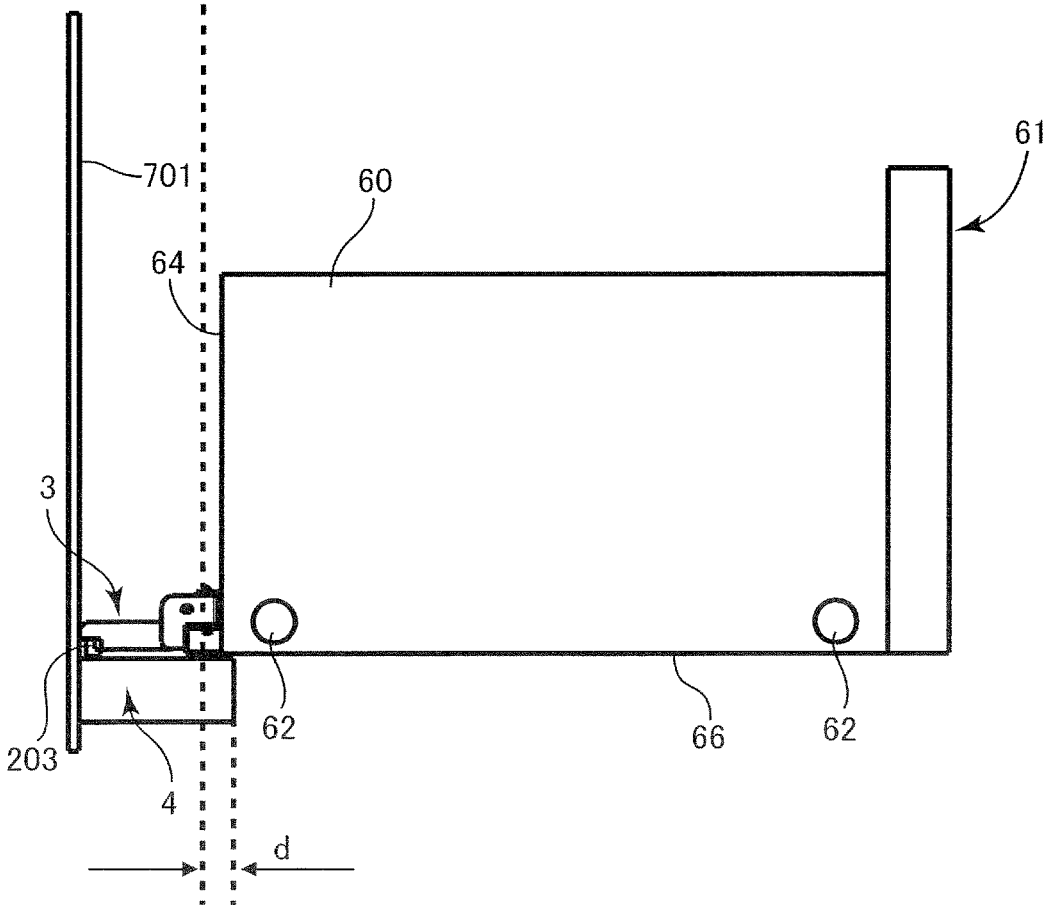
FIG. 6B is a side view illustrating an arrangement of a drawing mechanism according to the present embodiment.

FIG. 6A is a view illustrating a drawing arm unit 3 according to a modification example, and FIG. 6B illustrates the drawing arm unit 3 according to the present embodiment. If the drawing arm unit 3 is arranged close to the bottom plate 66 and the locking pin 203 of the drawing arm unit 3 is protruded upward, as illustrated in FIG. 6A, the storage body 60 and the drawing mechanism 4 are arranged in a superposed manner in the vertical direction. Meanwhile, if the locking pin 203 of the drawing arm unit 3 is arranged to protrude downward, as illustrated in FIG. 6B, the storage body 60 attached to the casing 200*a* and the drawing mechanism 4 can be arranged to be superposed with each other when viewed in the vertical direction.

By arranging the drawing mechanism 4 and the drawing arm unit 3 as illustrated in FIG. 6B, the side panel 701 of the casing 200*a* (refer to FIG. 2) and the rear wall 64 of the storage portion 61 can be approximated by distance d compared to the example of FIG. 6A. Therefore, the sheet feeding apparatus 200 can be downsized. Further, the sheet supporting apparatus 600 can be downsized in the horizontal direction, according to which the installation area of the printer 1 can be reduced.

Further, as illustrated in FIG. 5B, the locking pin 203 is fixed to the perpendicular swing arm 202 that is swingable in the upward direction, and the locking pin 203 is disposed to protrude downward from the bottom plate 66 in the non-loaded state. Therefore, even if external force containing an upward component acts on the locking pin 203 or the perpendicular swing arm 202, the locking pin 203 and the perpendicular swing arm 202 swing upward, by which damaging and deformation of the drawing arm unit 3 can be suppressed.

Figure 5C:
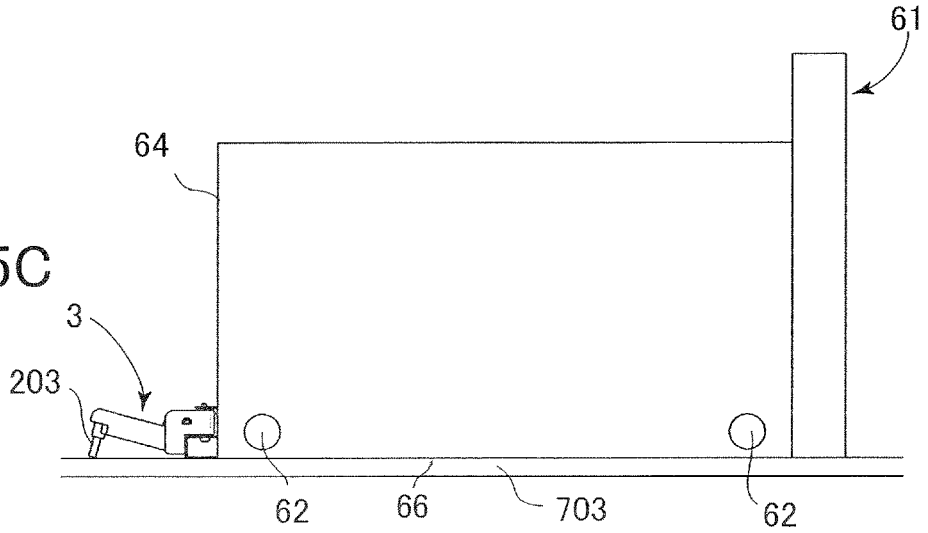
FIG. 5C is a side view illustrating a state in which the drawing arm unit is pushed up.
Figure 7A:
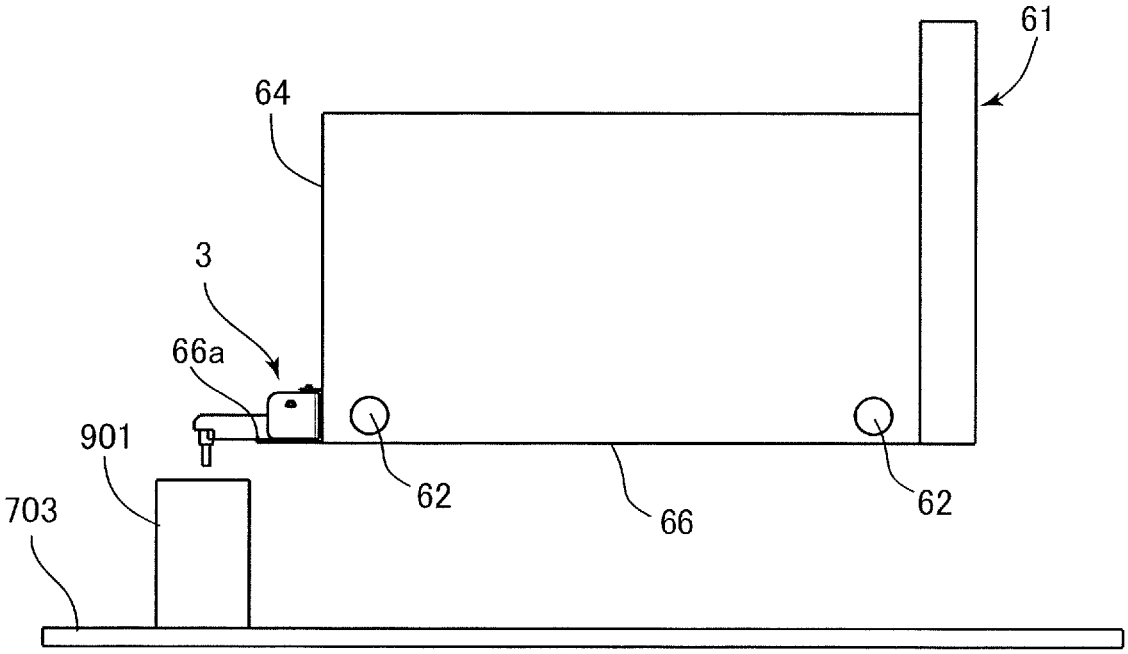
FIG. 7A is a side view illustrating a state immediately before the drawing arm unit contacts a loaded object.

For example, even if the storage portion 61 is drawn out of the casing 200*a* (refer to FIG. 2) and placed on a work surface 703 of the worktable, as illustrated in FIG. 5C, since the locking pin 203 can be retracted to an area above the bottom plate 66, damaging and deformation of the locking pin 203 can be suppressed. Furthermore, as illustrated in FIG. 7A, if a loaded object 901 is loaded on the work surface 703 and the drawing arm unit 3 contacts the loaded object 901 when placing the storage portion 61 on the work surface 703, the drawing arm unit 3 can swing upward, so that damaging and deformation of the drawing arm unit 3 can be suppressed.

Figure 7B:
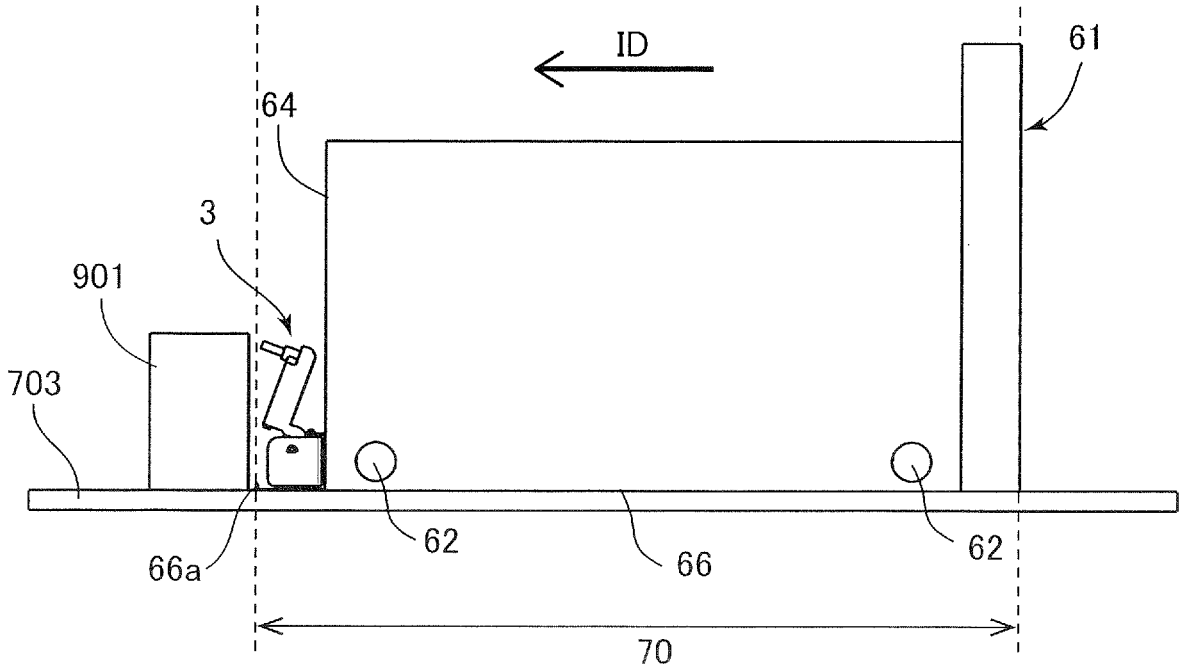
FIG. 7B illustrates a side view illustrating a position of the drawing arm unit being pushed up.

Furthermore, by the swinging of the perpendicular swing arm 202 in contact with the loaded object 901, as illustrated in FIG. 7B, the drawing arm unit 3 can move so as to be accommodated entirely within an area 70 in which the bottom plate 66 of the storage portion 61 is projected on a horizontal plane. That is, the entire drawing arm unit 3 can be positioned upstream of a downstream end 66*a* of the bottom plate 66 in the inserting direction ID of the storage portion 61. In other words, the entire drawing arm unit 3 can move to a position superposed with the bottom plate 66 when viewed in the vertical direction. Thereby, damaging and deformation of the drawing arm unit 3 can be reduced. Further, since there is no need to additionally provide another member such as a reinforcement member for improving the intensity of the locking pin 203, costs can be cut down.

Second Embodiment

Next, a second embodiment of the present invention will be described. According to the second embodiment, the configuration of the drawing arm unit 3 according to the first embodiment is changed. Therefore, configurations similar to the first embodiment are either not shown in the drawing or denoted with the same reference numbers.

Figure 8A:
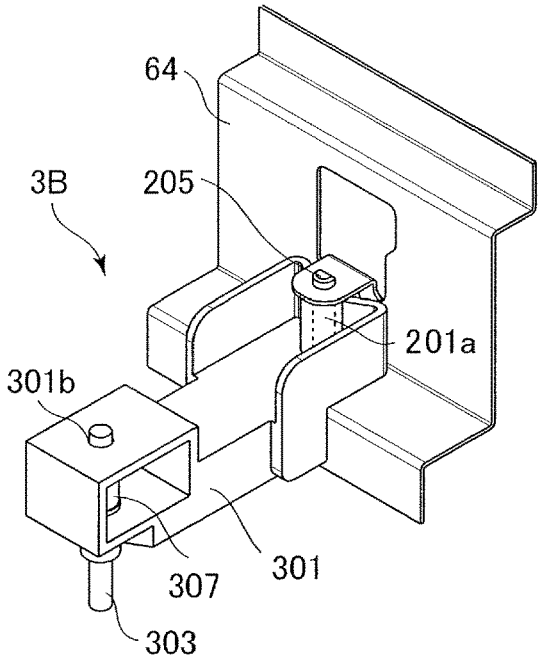
FIG. 8A is a perspective view illustrating a drawing arm unit according to a second embodiment.
Figure 8B:
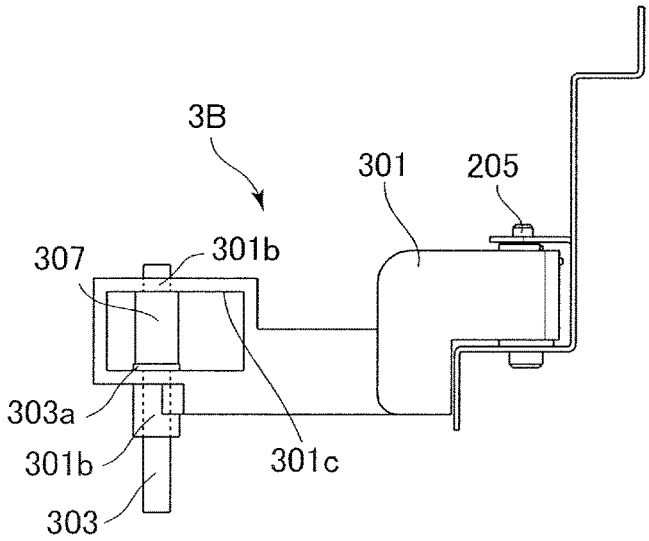
FIG. 8B is a cross-sectional view illustrating the drawing arm unit.

A drawing arm unit 3B serving as a first engagement unit according to the present embodiment includes, as illustrated in FIG. 8A, a horizontal swing arm 301, a locking pin 303 serving as a first engagement portion, an urging spring 307, and the horizontal arm shaft 205. The horizontal swing arm 301 serving as a holder is provided immovably in the vertical direction with respect to the storage body 60 (refer to FIG. 2), and is also supported swingably in the horizontal direction around the horizontal arm shaft 205. Pin holes 301*b* and 301*b* that extend in the vertical direction are formed at the leading end portion of the horizontal swing arm 301, as illustrated in FIG. 8B, and the locking pin 303 is inserted slidably in the pin holes 301*b* and 301*b*. The locking pin 303 is arranged so that the axial direction corresponds to the vertical direction, and it is supported movably in the vertical direction by the horizontal swing arm 301.

A spring bearing 303*a* is provided on the locking pin 303, and the urging spring 307 serving as an urging portion is arranged between the spring bearing 303*a* and a top panel 301*c* of the horizontal swing arm 301. The locking pin 303 is urged downward by the urging spring 307 in the non-loaded state, as illustrated in FIG. 8B, and the locking pin 303 is positioned at the standby position by the spring bearing 303*a* being caught at the edge portion of the pin hole 301*b*.

Figure 8C:
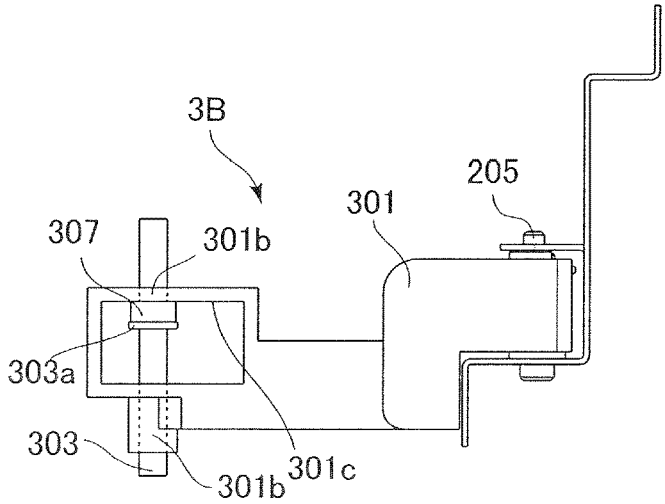
FIG. 8C is a cross-sectional view illustrating a state in which the locking pin is pushed up.

In a state where external force containing an upward component acts on the locking pin 303, the locking pin 303 slides upward with respect to the horizontal swing arm 301, as illustrated in FIG. 8C. That is, the locking pin 303 is positioned at the standby position in a state where external force is not applied, and in a state where external force containing a component in the vertical direction acts on the locking pin 303, the locking pin 303 moves in sliding motion in the vertical direction. In the present embodiment, sliding motion of the locking pin 303 in the downward direction is limited by the spring bearing 303*a* abutting against the edge portion of the pin hole 301*b*, but it is also possible to adopt a configuration where the locking pin 303 can move downward from the standby position. In a state where external force applied to the locking pin 303 is cancelled, the locking pin 303 returns to the standby position illustrated in FIG. 8B. Thereby, damaging and deformation of the locking pin 303 can be reduced.

Third Embodiment

Next, a third embodiment of the present invention will be described. According to the third embodiment, the configuration of the drawing arm unit 3 according to the first embodiment is changed. Therefore, configurations similar to the first embodiment are either not shown in the drawing or denoted with the same reference numbers.

Figure 9A:
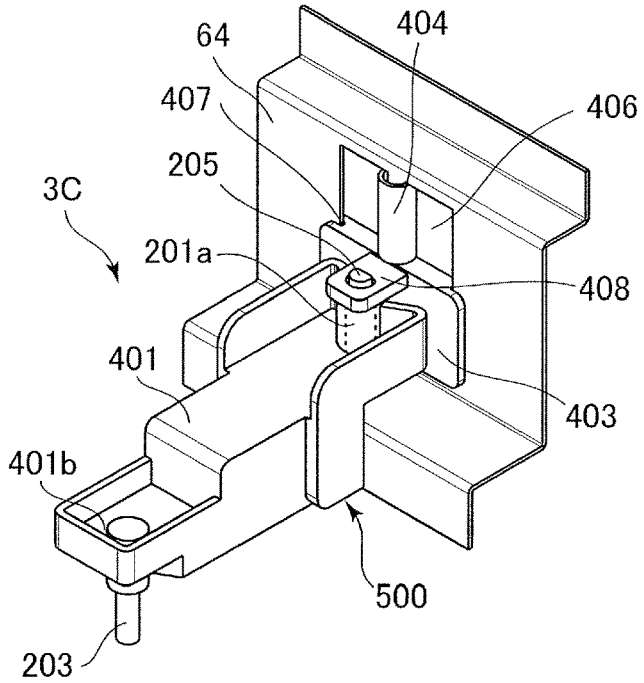
FIG. 9A is a perspective view illustrating a drawing arm unit according to a third embodiment.

A drawing arm unit 3C serving as a first engagement unit according to the present embodiment includes, as illustrated in FIG. 9A, a horizontal swing arm 401, the locking pin 203, an urging spring 404, the horizontal arm shaft 205, and a slider member 403. The horizontal swing arm 401, the horizontal arm shaft 205 and the slider member 403 constitute a holder 500 that retains the locking pin 203 movably in the perpendicular direction. A concave portion 406 is formed on the rear wall 64, and a pair of slide grooves 407 that extend in the vertical direction is formed on the slider member 403.

Side end portions of the concave portion 406 are engaged to the pair of slide grooves 407, and the slider member 403 is capable of moving in the vertical direction along the side end portions of the concave portion 406. The horizontal arm shaft 205 is attached to a bearing 408 provided on the slider member 403. The horizontal swing arm 401 is supported swingably in the horizontal direction around the horizontal arm shaft 205. That is, the horizontal swing arm 401 is supported swingably in the horizontal direction around the horizontal arm shaft 205 with respect to the slider member 403.

Figure 9B:
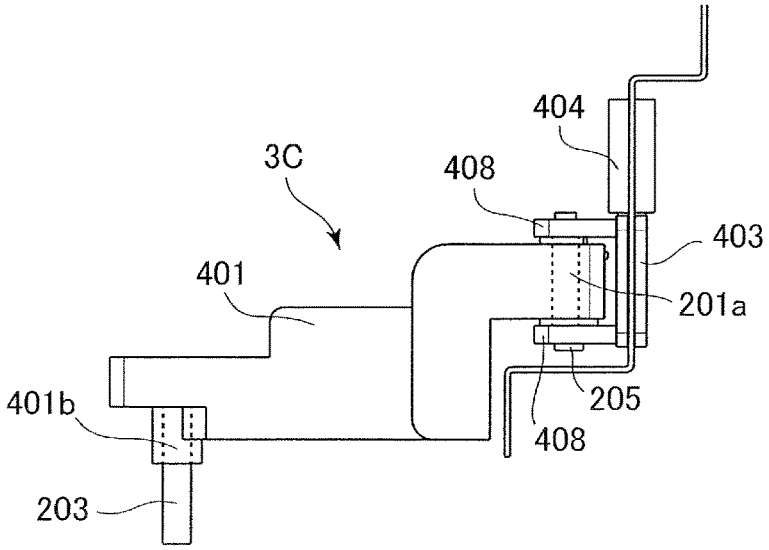
FIG. 9B is a cross-sectional view illustrating the drawing arm unit.

A pin hole 401*b* is formed at a leading end portion of the horizontal swing arm 401, and the locking pin 203 is fixed to the pin hole 401*b*. That is, the horizontal swing arm 401 serving as a retaining member is supported slidably in the vertical direction with respect to the rear wall 64 and fixes the locking pin 203. The urging spring 404 serving as the urging portion is arranged between the slider member 403 and the rear wall 64, and the urging spring 404 urges the slider member 403 downward. As illustrated in FIG. 9B, the slider member 403 is positioned by being abutted against a lower end of the concave portion 406 in the non-loaded state.

Figure 9C:
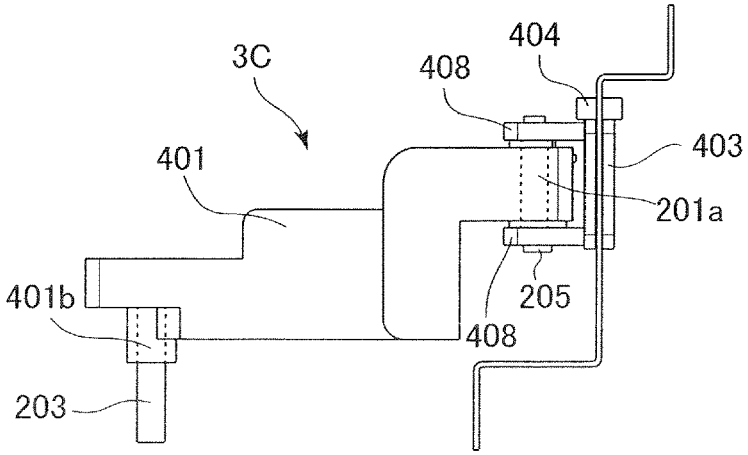
FIG. 9C is a cross-sectional view illustrating a state in which the drawing arm unit is pushed up.

In a state where external force containing an upward component acts on the drawing arm unit 3C, the slider member 403 moves upward in sliding motion with respect to the rear wall 64, as illustrated in FIG. 9C. That is, the locking pin 203 is positioned at the standby position in a state where external force is not applied, and in a state where external force containing a component in the vertical direction acts on the locking pin 203, the locking pin 203 moves in sliding motion in the vertical direction together with the slider member 403 and the horizontal swing arm 401. In the present embodiment, movement of the locking pin 203 in the downward direction is regulated by the slider member 403 abutting against the lower edge portion of the concave portion 406, but the present invention can also adopt a configuration where the locking pin 203 can move downward from the standby position. In a state where external force applied to the drawing arm unit 3C is cancelled, the drawing arm unit 3C returns to the state illustrated in FIG. 9B. Thereby, damaging and deformation of the drawing arm unit 3C including the locking pin 203 can be reduced.

According to the second and third embodiments, as described in FIG. 5B, the locking pin is protruded downward than the extension plane 702 of the bottom plate 66 in the standby state, and it can be moved upward from the standby position.

In all the embodiments described above, especially the locking pin among the drawing mechanism is movable in the vertical direction, but the present invention is not limited to this configuration. A member constituting the drawing mechanism other than a locking pin can be provided movably in the vertical direction, as long as the member can receive application of external force. For example, the perpendicular swing arm 202 according to the first embodiment and the horizontal swing arm 401 according to the third embodiment are configured movable in the vertical direction with respect to the storage body 60. Therefore, it is necessary to configure at least a portion of the drawing mechanism movably in the vertical direction.

In all the embodiments described above, a deck-type storage portion was described, but the present invention is not limited thereto. For example, the present invention is applicable to a cassette-type storage portion. Further, in all the embodiments described above, the urging spring 206, 307 or 404 was used to urge the locking pin to the standby position, but the present invention is not limited thereto. It is also possible to omit the urging spring and to adopt a configuration where the locking pin is urged to the standby position by gravity. Further, in the first and third embodiments, the locking pin 203 was fixed to the perpendicular swing arm 202 or the horizontal swing arm 401, but the present invention is not limited thereto. For example, the locking pin 203 can be supported slidably in the vertical direction with respect to the perpendicular swing arm 202 and the horizontal swing arm 401.

Further, in all the embodiments described above, the printer 1 adopting an electrophotographic system was described, but the present invention is not limited thereto. For example, the present invention is applicable to an image forming apparatus adopting an ink-jet system in which an image is formed on a sheet by discharging ink through a nozzle.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-225288, filed Nov. 30, 2018, which is hereby incorporated by reference herein in its entirety.

What is claimed is:

1. A sheet supporting apparatus comprising:

an apparatus body;

a sheet supporting unit comprising a sheet supporting portion including a supporting surface on which a sheet is supported, and a first engagement unit attached to the sheet supporting portion, the sheet supporting unit being configured to be attached to and drawn out of the apparatus body; and a second engagement unit provided on the apparatus body and configured to draw in the sheet supporting unit toward an attaching position where the sheet supporting unit is attached to the apparatus body, wherein the first engagement unit comprises a first engagement portion, a base portion configured to be supported by the sheet supporting portion, and a holder that is supported movably in a perpendicular direction perpendicular to the supporting surface by the base portion and configured to hold the first engagement portion, the second engagement unit comprises a second engagement portion configured to engage with the first engagement portion, and a drawing-urging portion configured to urge the second engagement portion so that the sheet supporting unit is drawn toward the attaching position in a state where the second engagement portion is engaged with the first engagement portion, and the base portion is configured to support the holder swingably around a swing shaft that extends in a direction orthogonal to both the perpendicular direction and an inserting direction in which the sheet supporting unit is inserted.

2. The sheet supporting apparatus according to claim 1, wherein the base portion is supported swingably around a shaft that extends in the perpendicular direction with respect to the sheet supporting portion.

3. The sheet supporting apparatus according to claim 2, wherein the base portion is provided immovably in the perpendicular direction with respect to the sheet supporting portion.

4. The sheet supporting apparatus according to claim 1, wherein the first engagement portion is fixed to the holder.

5. The sheet supporting apparatus according to claim 1, wherein the holder retains the first engagement portion at a standby position in a state where external force is not applied, and the first engagement portion swings in the perpendicular direction around the swing shaft together with the holder in a state where external force including a component in the perpendicular direction is applied.

6. The sheet supporting apparatus according to claim 5, wherein the perpendicular direction is a vertical direction, and the first engagement portion is configured to protrude lower than a bottom plate of the sheet supporting portion at the standby position and configured to move from the standby position to a position above the bottom plate.

7. The sheet supporting apparatus according to claim 5, wherein the first engagement unit comprises an urging portion configured to urge the holder so as to position the first engagement portion at the standby position.

8. The sheet supporting apparatus according to claim 1, wherein the first engagement unit is configured to move by the holder swinging around the swing shaft so as to be accommodated entirely within an area in which a bottom plate of the sheet supporting portion is projected on a horizontal plane.

9. The sheet supporting apparatus according to claim 1, wherein the second engagement unit is arranged so as to overlap with the sheet supporting portion attached to the apparatus body when viewed in the perpendicular direction.

10. The sheet supporting apparatus according to claim 1, wherein the second engagement portion is configured to swing around a shaft that extends in the perpendicular direction.

11. An image forming apparatus comprising:

the sheet supporting apparatus according to claim 1; and an image forming unit configured to form an image on a sheet fed from the sheet supporting apparatus.

12. A sheet supporting apparatus comprising:

an apparatus body;

a sheet supporting unit comprising a sheet supporting portion including a supporting surface on which a sheet is supported, and a first engagement unit attached to the sheet supporting portion, the sheet supporting unit being configured to be attached to and drawn out of the apparatus body; and a second engagement unit provided on the apparatus body and configured to draw in the sheet supporting unit toward an attaching position where the sheet supporting unit is attached to the apparatus body, wherein the first engagement unit comprises a first engagement portion, and a holder that is supported movably in a perpendicular direction perpendicular to the supporting surface and configured to hold the first engagement portion, the second engagement unit comprises a second engagement portion configured to engage with the first engagement portion, and a drawing-urging portion configured to urge the second engagement portion so that the sheet supporting unit is drawn toward the attaching position in a state where the second engagement portion is engaged with the first engagement portion, and wherein the holder comprises a slider member configured to be supported slidably in the perpendicular direction with respect to the sheet supporting portion, and a retaining member configured to be supported by the slider member and retaining the first engagement portion.

13. The sheet supporting apparatus according to claim 12, wherein the slider member is configured to support the retaining member swingably around a shaft that extends in the perpendicular direction.

14. The sheet supporting apparatus according to claim 12, wherein the first engagement portion is fixed to the retaining member.

15. The sheet supporting apparatus according to claim 12, wherein the holder is configured to retain the first engagement portion at a standby position in a state where external force is not applied, and the first engagement portion is configured to move in sliding motion in the perpendicular direction together with the slider member and the retaining member in a state where external force containing a component in the perpendicular direction is applied.

16. The sheet supporting apparatus according to claim 15, wherein the perpendicular direction is a vertical direction, and the first engagement portion is configured to protrude lower than a bottom plate of the sheet supporting portion at the standby position and configured to move from the standby position to a position above the bottom plate.

17. The sheet supporting apparatus according to claim 15, wherein the first engagement unit comprises an urging portion configured to urge the slider member so as to position the first engagement portion at the standby position.

* * * * *